United States Patent [19]

Griffith

[11] Patent Number: 4,623,007

[45] Date of Patent: Nov. 18, 1986

[54] DEVICE FOR METERING WEFT YARN

[75] Inventor: John D. Griffith, Cleadon, England

[73] Assignee: Sulzer Brothers Limited, Winterthur, Switzerland

[21] Appl. No.: 755,160

[22] Filed: Jul. 15, 1985

[30] Foreign Application Priority Data

Jul. 21, 1984 [GB] United Kingdom ..... 8418669

[51] Int. Cl.[4] ..... D03D 47/36

[52] U.S. Cl. ..... 139/452; 139/435

[58] Field of Search ..... 139/435, 452; 242/47.01, 47.12, 47.13

[56] References Cited

U.S. PATENT DOCUMENTS 4,498,639 2/1985 Deborde et al. ..... 139/452
4,509,563 4/1985 Goseiniak et al. ..... 139/452
4,544,001 10/1985 Moessinger et al. ..... 139/452

FOREIGN PATENT DOCUMENTS 2140045 11/1984 United Kingdom ..... 139/452

*Primary Examiner*—Henry S. Jaudon
*Attorney, Agent, or Firm*—Werner W. Kleeman

[57] ABSTRACT

A weft yarn metering device for a fluid loom includes a rotatable spool about which weft yarn is wrapped. The spool has an axis of rotation extending transverse to the direction of weft yarn insertion and preferably continuously rotates. A weft yarn guide is movable between a first position and a second position. The weft yarn guide is aligned with the direction of weft insertion in the first position in order to enable weft yarn to be dispensed from the spool and is aligned with the axis of rotation of the spool in the second position to enable wrapping of yarn about the spool.

5 Claims, 2 Drawing Figures

DEVICE FOR METERING WEFT YARN

BACKGROUND OF THE INVENTION

The present invention broadly relates to a device for metering weft yarn for insertion in a fluid weaving loom and, more specifically, pertains to a new and improved construction of a weft yarn metering device for a fluid loom.

During the recent development of fluid looms, the achievement of high operating speeds has always been a major goal. One limiting factor encountered in the quest for high operating speeds is the speed at which weft yarn is metered and dispensed for each pick of the loom.

It is known to provide weft yarn metering devices having a spool around which yarn is wrapped, the spool being arranged so that its axis is substantially axially aligned with the direction of weft insertion. Examples of this type of weft metering device are described in published European Patent Application No. 0 080 692 and in applicant's European Patent Application No. 82,902,075.9.

As will be appreciated from the aforementioned European Patent Application No. 0 080 692, when weft yarn is pulled off the spool the yarn tends to balloon in front of the spool and this ballooning effect tends to create a drag on the yarn thereby reducing the speed at which it can be inserted across the warp shed by the weft insertion nozzle. This drag on the yarn is in addition to that required for pulling the yarn off the spool.

SUMMARY OF THE INVENTION

Therefore, with the foregoing in mind, it a primary object of the present invention to provide a new and improved construction of a weft yarn metering device which does not exhibit the aforementioned drawbacks and shortcomings of the prior art constructions.

Another and more specific object of the present invention aims at providing a new and improved construction of a weft yarn metering device of the previously mentioned type which eliminates the ballooning effect and so reduces or eliminates the drag caused thereby.

A further object of the present invention also aims to reduce the drag created in pulling yarn from the spool.

Now in order to implement these and still further objects of the invention, which will become more readily apparent as the description proceeds, the weft yarn metering device of the present invention is manifested by the features that the device includes a rotatable spool about which weft yarn is wrapped, the spool having an axis of rotation which is transverse to the direction of weft insertion. Preferably the spool continuously rotates and a movable weft yarn guide is provided, the guide being movable between a first position whereat it is aligned with the direction of weft insertion so as to enable weft yarn to be discharged from the spool, and a second position whereat it is aligned with the axis of rotation of the spool to enable wrapping of yarn about the spool.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
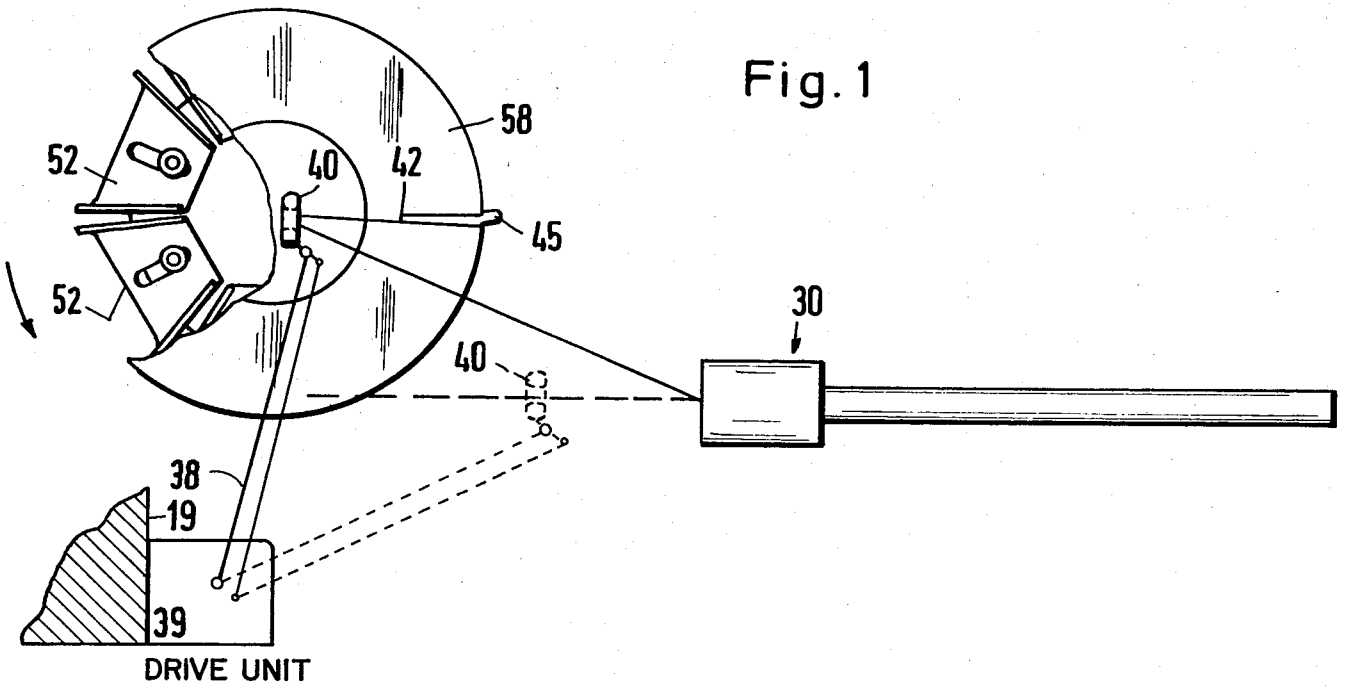
FIG. 1 is an end view of a weft yarn metering device according to the present invention.
Figure 2:
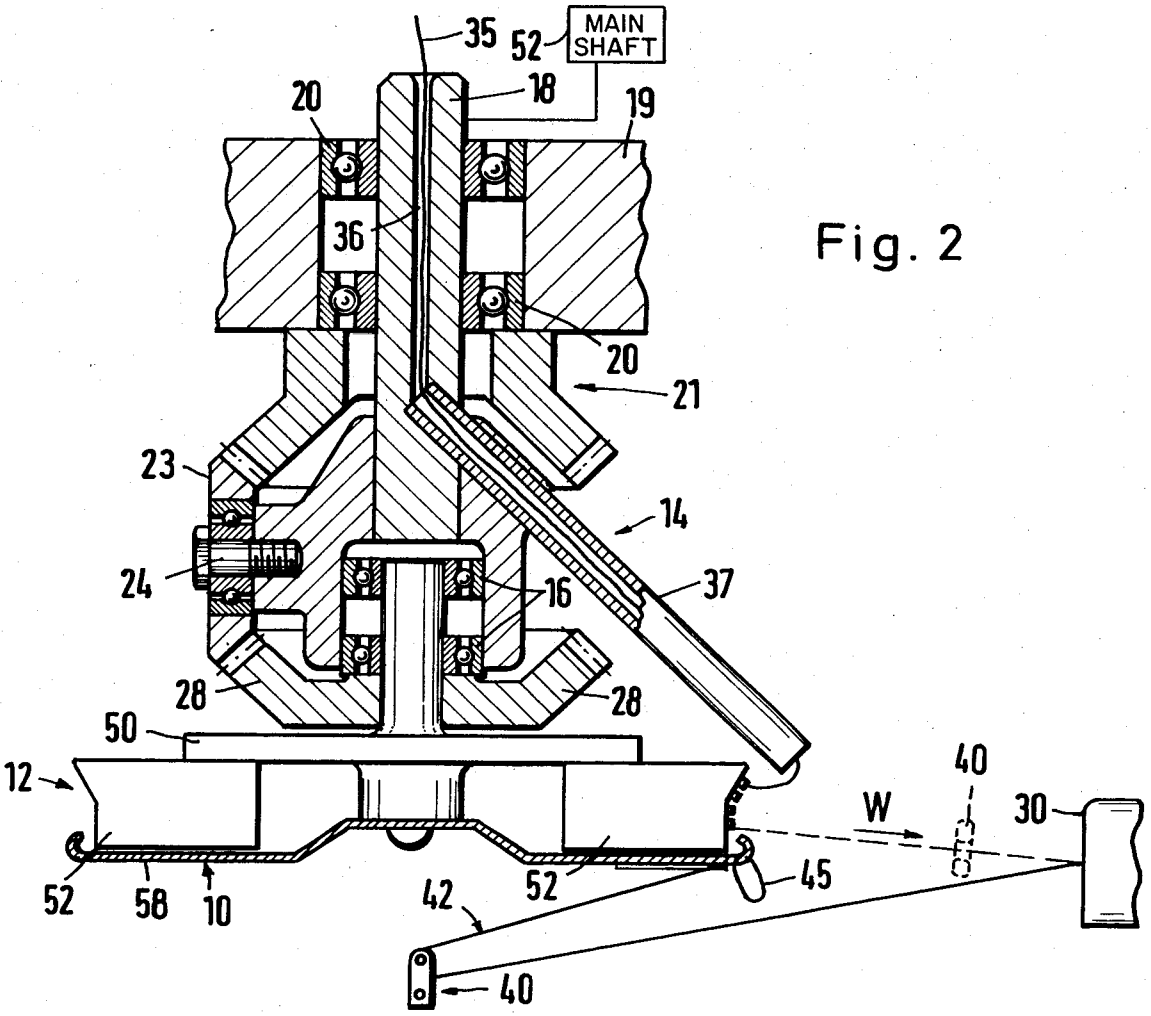
FIG. 2 is a plan view, partly in axial section, of the device illustrated in FIG. 1.

Describing now the drawings, it is to be understood that to simplify the showing thereof only enough of the structure of the weft yarn metering device and the related weaving machine have been illustrated therein as is needed to enable one skilled in the art to readily understand the underlying principles and concepts of this invention. Turning now specifically to FIGS. 1 and 2 of the drawings, the device illustrated therein by way of example and not limitation will be seen to comprise a rotatable spool 12 which is rotatably mounted in a rotatable boss 14 via a pair of bearings 16 by the intermediary of a support 50. The rotatable boss 14 is rendered rotatable in a manner to be described hereinbelow. The spool 12 is located behind a weft insertion nozzle 30 which in use is supplied with pressurised fluid (usually air) for shooting or inserting weft yarn 35 across the warp shed. As seen in the drawings, the axis of rotation of the rotatable spool 12 is positioned so as to extend transverse to the axis of the weft insertion nozle 30 and to the direction W of weft insertion. It is to be appreciated that, in the context of this specification, the term "transverse" includes positions of the axis of rotation of the rotatable spool 12 which extend only generally perpendicular to the axis of the weft insertion nozzle 30 as well as being substantially exactly perpendicular as illustrated.

A shaft 18 projects from the rotatable boss 14 and is rotatably mounted in a frame member 19 (only shown in part) of the weaving machine or loom (not shown) via bearings 20. As explained hereinafter, the rotatable shaft 18 can be driven from a main shaft, generally indicated in FIG. 2 by reference numeral 25, of the weaving machine or loom.

An annular bevel toothed gear 21 is secured to the frame member 19 and meshes with a bevel gear 23 which is rotatably mounted on a shaft 24. The shaft 24 is fixedly secured to the rotatable boss 14. The bevel gear 23 meshes with a further bevel gear 28 secured to the rotatable spool 12.

Thus, since the shaft 18 rotatably mounted in the frame member 19 by the bearings 20 is fixed to the rotatable boss 14, rotation of the shaft 18 by, for instance, the main shaft 25 causes the rotatable boss 14 to rotate and also the rotatable spool 12 to rotate in the same direction at a greater relative speed dictated by the relative sizes of the bevel gears 21, 23 and 28. Preferably, the spool 12 is driven at twice the speed of the rotatable boss 14.

The shaft 18 is also preferably driven continuously at a constant speed from the main shaft 25 of the weaving machine or loom. Accordingly, the spool 12 is likewise driven continuously and at a constant speed, the speed of rotation of the spool 12 being chosen such that the peripheral speed of the spool 12 is the same as the required speed of insertion of the weft yarn 35. Between the end of one weft insertion and the beginning of the next, no weft yarn 35 is withdrawn or unwound from the spool 12, as will be explained in more detail hereinbelow. Hence, the spool 12 provides a positive control of the speed of insertion of the weft yarn 35.

As mentioned above, the axis of rotation of the spool 12 is oriented transversely to the direction W of weft insertion and is preferably arranged so that the axis of the weft insertion nozzle 30 is tangential to the periphery of the spool 12.

Weft yarn 35 is supplied in a manner to be described hereinbelow to the spool 12 from a yarn package (not shown) via a bore 36 in the shaft 18 and a tube 37 which projects from the rotatable boss 14.

As shown in FIGS. 1 and 2, a movable annularly structured yarn guide 40 is provided through which weft yarn 35 passes betweeen the spool 12 and weft insertion nozzle 30. The substantially annular yarn guide 40 is movable between a first position (as illustrated in dotted lines) and a second position (as illustrated in full lines). Details relevant to this motion will be presented hereinbelow. At the first position, the yarn guide 40 is in line with the direction W of weft insertion, i.e. an axis of rotational symmetry of the substantially annular yarn guide 40 substantially coincides with the direction W, and thereby allows weft yarn 35 to pass from the spool 12 to the weft insertion nozzle 30. At the second position, the yarn guide 40 is positioned at the axis of rotation of the spool 12 and thus out of line with the direction W, thereby inhibiting the weft yarn 35 from passing to the weft insertion nozzle 30. At this second position, a weft yarn portion 42 extends from the yarn guide 40 to the periphery or perimeter of the spool 12 and is engaged by a projection 45.

The weft yarn portion 42 is thus constrained to rotate conjointly with the spool 12 between the end of one weft insertion and the beginning of the next, effectively preventing withdrawal or unwinding of the weft yarn 35 from the spool 12 during this period. Weft yarn 35 therefore accumulates on the spool 12 between weft insertions in preparation for the next weft insertion. The projection 45 is, as shown in FIGS. 1 and 2, a substantially flat wing or ear having smooth edges and is upstanding or protruding away from the spool 12 at the periphery of the spool 12 on the side remote from the tube 37. As will be apparent from the description to follow, the substantially flat projection 45 is arranged to rotate with the spool 12 and engage the weft yarn portion 42 once per revolution when the yarn guide 40 is in its second position.

The yarn guide 40 resides at its first position during weft insertion and with the yarn guide 40 in this position, weft yarn 35 is positively unwound from spool 12 by virtue of rotation of the spool 12 and is driven towards the weft insertion nozzle 30. As a result, there is no ballooning of the weft yarn 35 as it leaves the spool 12. The yarn guide 40 is suitably driven between its first and second positions by a conventional drive, such as a conventional parallelogram linkage 38 and a conventional drive unit 39 mounted to the frame member 19. Drives of this type are well known in the art as exemplified by U.S. Pat. No. 3,276,484, granted Oct. 4, 1966, to which reference may be readily had.

During weft insertion, the relative rotation between the tube 37 and the spool 12 causes the weft yarn 35 to be continually wrapped about the periphery of the spool 12 nearest the tube 37, as shown in FIG. 2 simultaneously with weft yarn 35 being unwound from the periphery of the spool 12 at a side thereof which is remote from the tube 37, as shown in FIG. 2 as it is fed toward the weft insertion nozzle 30. Consequently, during insertion several turns of weft yarn 35 are always in contact with the spool 12 which ensures there is no slippage between the weft yarn 35 and the spool 12. Thus consistent metering of the weft yarn 35 is ensured, since the elimination of slippage causes weft yarn 35 to rotate at the speed of the spool 12, which as already described is twice that of the tube 37, and thereby to be delivered from the tube 37 to the spool 12 at a precise rate. As will be apparent from FIG. 2, the spool 12 is formed in conventional manner with a conical region which cooperates with the tension forces in the weft yarn 35 being metered to cause the weft yarn 35 to gradually advance from the periphery of the spool 12 nearest the tube 37 where the weft yarn 35 is delivered towards the periphery of the spool 12 at the side remote from the tube 37 where the weft yarn 35 is withdrawn and fed to the weft insertion nozzle 30. A suitable conical configuration of the spool 12 is shown in the U.S. Pat. No. 3,411,548, granted Nov. 19, 1968. As this patent explains, each newly wound loop of thread displaces the previously wound loop and causes successive loops to advance toward the opposite side of the spool, i.e. the side remote from the tube 37.

At the end of weft insertion, the yarn guide 40 moves to its second position in timed relationship with rotation of the spool 12 to ensure that weft yarn 35 is engaged by the projection 45. The timing is such that during weft insertion the spool 12 completes a predetermined number of rotations before the yarn guide 40 is moved to its second position. As should be readily apparent, especially from the showing of FIG. 2, in moving from the first to the second position, the yarn guide 40 increases the path length of the weft yarn 35. The requisite extra length of weft yarn 35 is withdrawn from the periphery of the spool 12 on the side remote from the tube 37 before the timing of rotation causes the weft yarn and its portion 42 to be engaged by the projection 45. When the yarn guide 40 is at its second position, weft yarn 35 is rapidly wrapped about the spool 12 in preparation for the next weft insertion, since the spool 12 rotates at twice the speed of the tube 37. Due to such double speed rotation of the spool 12 this effects the accumulation between insertions on the spool 12 of a sufficiently great and accurately metered length of weft yarn for withdrawal and feed to the weft insertion nozzle 30 at the next insertion.

By suitably changing the timing of movement of the yarn guide 40 from its first position to its second position, it is possible to easily alter the length of the metered weft yarn 35 by units equivalent to the periphery or circumference of the spool 12. For instance, by waiting three revolutions of the spool 12 before effecting this movement, a length of weft yarn 35 is metered out to the weft insertion nozzle 30 which is equivalent to three times the circumference of the spool 12. Waiting four revolutions would meter four circumferential lengths, et cetera. If more than one projection 45 is provided, the timing adjustment could be used to alter the metered length by portions of a periphery or circumference also. This type of adjustment gives a coarse adjustment to metered length. For instance, by waiting three and one-half revolutions of the spool 12 before moving the yarn guide 40 from its first position to its second position, a length of weft yarn equivalent to three and one-half circumferences of the spool 12 would be metered out to the weft insertion nozzle 30.

Preferably, as illustrated in FIG. 1, the spool 12 is of a segmented construction containing the segments 52 so as to enable its diameter to be quickly and easily adjusted. Adjustment of diameter enables a finer adjustment of the metered length of weft yarn 35 to be made.

The illustrated spool 12 includes a support 50 of disc shape to which several segments 52 are attached. The number of segments 52 is chosen so as to give a desirable peripheral profile to the spool 12. The radial position of each segment 52 is adjustable so that it can be nearer or further spaced from the axis of rotation of the spool 12 to vary the effective diameter of the spool 12.

As shown in FIG. 2, a substantially flat discoidal guard member 58 having a flanged or upturned outer edge is provided in front of the segments 52 at the side of the spool 12 remote from the tube 37 in order to prevent snagging the portion 42 of the weft yarn 35 by preventing the yarn portion 42 from inadvertently entering between the segments 52. This permits the projection 45 to sweep the yarn portion 42 around the yarn guide 40 in its second position without snagging. The guard 58 rotates with the spool 12. Conveniently, the projection 45 is mounted on guard 58.

While there are shown and described present prefered embodiments of the invention, it is to be distinctly understood that the invention is not limited thereto, but may be otherwise variously embodied and practised withing the scope of the following claims. Accordingly,

What I claim is:

1. A weft yarn metering device for a fluid loom having a predetermied direction of weft yarn insertion, comprising:

a rotatable spool for wrapping weft yarn and having an axis of rotation extending transverse to said predetermined direction of weft yarn insertion;

a movable weft yarn guide having a first position and a second position;

said movable weft yarn guide being substantially aligned with said predetermined direction of weft yarn insertion for allowing said weft yarn to be withdrawn from said rotatable spool when said movable weft yarn guide is in said first position; and said movable weft yarn guide being substantially aligned with said axis of rotation of said rotatable spool for allowing yarn to be wrapped about said rotatable spool when said movable weft yarn guide is in said second position.

2. The weft yarn metering device as defined in claim 1, wherein:

said rotatable spool is continuously rotatable.

3. The weft yarn metering device as defined in claim 1, wherein:

the fluid loom includes a weft insertion nozzle having an axis substantially defining said predetermined direction of weft yarn insertion;

said rotatable spool having a periphery; and said axis of said weft insertion nozzle extending in substantially tangential relation to said periphery.

4. The weft yarn metering device as defined in claim 1, further including:

means for causing said rotatable spool to rotate with a predetermined peripheral speed;

said weft yarn having a predetermined speed of insertion; and said predeterminate peripheral speed and said predetermined speed of insertion being substantially equal.

5. The weft yarn metering device as defined in claim 1, wherein:

said rotatable spool comprises a plurality of radially adjustable spool segments.

* * * * *